US007727083B2

(12) United States Patent
Takeuchi

(10) Patent No.: US 7,727,083 B2
(45) Date of Patent: Jun. 1, 2010

(54) GOLF CLUB SHAFT

(75) Inventor: Hiroyuki Takeuchi, Hyogo (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 11/729,783

(22) Filed: Mar. 30, 2007

(65) Prior Publication Data

US 2007/0238546 A1 Oct. 11, 2007

(30) Foreign Application Priority Data

Apr. 11, 2006 (JP) ..... 2006-108305

(51) Int. Cl.
*A63B 53/10* (2006.01)

(52) U.S. Cl. ..... 473/319

(58) Field of Classification Search ..... 473/316–323
See application file for complete search history.

(56) References Cited

U.S. PATENT DOCUMENTS

| | | | | |
|---|---|---|---|---|
| 3,646,610 | A * | 2/1972 | Jackson | 473/319 |
| 3,998,458 | A * | 12/1976 | Inoue et al. | 473/319 |
| 5,265,872 | A * | 11/1993 | Tennent et al. | 473/320 |
| 6,306,047 | B1 * | 10/2001 | Kusumoto | 473/319 |
| 6,354,957 | B1 * | 3/2002 | Saito | 473/289 |
| 6,533,677 | B1 * | 3/2003 | Sumitomo et al. | 473/316 |
| 6,767,422 | B1 * | 7/2004 | Atsumi et al. | 156/184 |
| 6,905,422 | B2 * | 6/2005 | Atsumi et al. | 473/319 |

FOREIGN PATENT DOCUMENTS

| | | | |
|---|---|---|---|
| JP | 8-308969 | A | 11/1996 |
| JP | 2528576 | Y2 | 12/1996 |
| JP | 2001-161872 | A | 6/2001 |
| JP | 2001-204865 | * | 7/2001 |
| JP | 2003-180890 | A | 7/2003 |
| JP | 2004-305332 | A | 11/2004 |

* cited by examiner

*Primary Examiner*—Stephen L. Blau
(74) *Attorney, Agent, or Firm*—Birch, Stewart, Kolasch & Birch, LLP

(57) ABSTRACT

A golf club shaft having at least six full-length layers composed of prepregs. The full-length layers are divided into an inner-layer part including a half of the full-length layers and an outer-layer part including a remaining half of the full-length layers. At least one pair of the full-length layers is formed as a bias set layer in each of the inner-layer part and the outer-layer part by layering two bias layers with each other, with reinforcing fibers of the bias layers intersecting with each other at an orientation angle of ±θ° which fall in a range from ±25° to ±65° with respect to an axis of the golf club shaft. A straight layer is formed as an outermost full-length layer of the outer-layer part with reinforcing fiber thereof orienting at the range from 0° to ±10° with respect to the axis of the shaft.

4 Claims, 9 Drawing Sheets

GOLF CLUB SHAFT

This nonprovisional application claims priority under 35 U.S.C. §119(a) on Patent Application No(s). 2006-108305 filed in Japan on Apr. 11, 2006, the entire contents of which are hereby incorporated by reference.

FIELD OF THE INVENTION

The present invention relates to a golf club shaft (hereinafter often referred to as merely shaft). More particularly, the present invention is intended to make the strength of a lightweight golf club shaft high and allow it to hit a golf ball a long distance in a desired direction.

DESCRIPTION OF THE RELATED ART

In recent years, to allow a golfer to hit a golf ball a long distance, the present tendency is to make a golf club shaft and a golf club head lightweight. Therefore the present tendency is to replace steel which has been mainly used as a material of the golf club shaft with fiber reinforced resin such as a carbon prepreg that is lightweight and has a high specific strength and specific rigidity.

As a layered construction of the golf club shaft made of the fiber reinforced resin, conventionally a bias layer influencing the torque of the shaft is disposed in the inner-layer part thereof, whereas a straight layer influencing the flexure thereof is disposed in the outer-layer part thereof.

Normally the weight of the shaft is decreased by decreasing the volume (weight of prepreg per area and number of layers) of a prepreg. But this method leads to a decrease in the strength of the shaft and an increase in the torque and flexure thereof. That is, a head speed is increased by making the shaft lightweight. When the degree of torque is high, it takes longer for the head to return to its original position, which causes the shaft a hit ball to depart from a desired direction. When the degree of flexure is high, the shaft is soft. Consequently the shaft flexes excessively to generate an energy loss, which prevents the ball from being hit a long distance.

As a method of decreasing the torque, it is normal to increase the per-area weight of the bias layer which influences the torque of the shaft or allow fibers of the fiber reinforced resin to have a high elasticity. As a method of decreasing the flexure of the shaft, it is normal to increase the per-area weight of the straight layer which influences the flexure of the shaft or allow the fibers of the fiber reinforced resin to have a high elasticity. But to increase the per-area weight of the bias layer or the straight layer is contradictory to the present tendency of making the shaft lightweight. When the tensile modulus of elasticity of the fiber is set to as high as 30 t to allow the fibers to have a high elasticity, the shaft has a low strength.

Therefore it is necessary to provide the shaft with a desired degree of flexure and torque with the shaft maintaining the desired weight and strength.

To solve the above-described problem, in the golf club shaft disclosed in Japanese Patent Application Laid-Open No. 2003-180890 (patent document 1), the bias layer having the fibrous angle of ±20° to 65° is formed at the intermediate part of the shaft to thereby allow the shaft to have a high vibration-absorbing property and hit a golf ball in a desired direction without changing a desired weight of the shaft. But the shaft cannot be made lightweight when the shaft is provided with the bias layer. When the bias layer is formed on the shaft instead of the straight layer and the hoop layer, the shaft is liable to have a low bending strength and crushing strength. Thus the shaft has room for improvement.

The golf club shaft disclosed in Japanese Patent Application Laid-Open No. 2004-305332 (patent document 2) is composed of the bias layer, forming the inner layer of the shaft, in which the orientation angle of the fiber is ±35° to 55°; the straight layer forming the outer layer thereof; and the bias layer, forming at least one part of the outermost layer, in which the orientation angle of the fiber is ±5° to 30°. In this construction, the bias layer forming the inner layer enhances the twist rigidity of the shaft. The straight layer forming the outer layer enhances the bending rigidity. The bias layer forming the outermost layer decreases the deformation amount of the fiber and enhances the bending strength thereof. Because it is necessary to polish the outermost layer before it is painted, the bias layer forming the outermost layer is polished. Therefore there is a fear that this construction is incapable of providing the shaft with the desired degree of strength and torque.

As shown in FIG. 10, the golf club shaft 1 disclosed in Japanese Patent Application Laid-Open No. 8-308969 (patent document 3) is composed of the first bias layer 2, the straight layer 3 disposed outward from the bias layer 2, the second bias layer 4 disposed outward from the straight layer 3, and the shaft surface-adjusting layer 5 disposed on the surface of the second bias layer 4. According to the description made in the specification, the shaft 1 is vibration-proof and shock-proof against an impact applied thereto when a golf ball is hit. But the number of the bias layers 2, 4 and the positions of the bias layers 2, 4 are not described in maintaining a balance among the strength, weight, flexure, and torque of the shaft. The shaft is incapable of having the desired performance.

Patent document 1: Japanese Patent Application Laid-Open No. 2003-180890

Patent document 2: Japanese Patent Application Laid-Open No. 2004-305332

Patent document 3: Japanese Patent Application Laid-Open No. 8-308969

SUMMARY OF THE INVENTION

The present invention has been made in view of the above-described problems. Therefore it is an object of the present invention to provide a golf club shaft which is lightweight and has a high strength in a favorable balance and has a desired degree of flexure and torque to hit a ball a long distance and in a desired direction.

To achieve the object, the present invention provides a golf club shaft composed of a laminate of prepregs, at least six full-length layers of which are formed over a full length of the golf club shaft. The full-length layers are divided into an inner-layer part, including a half of the full-length layers, which is disposed at a central side of the golf club shaft and an outer-layer part, including a remaining half of the full-length layers, which is disposed at an outer side of the golf club shaft. At least one pair of the full-length layers is formed as a bias set layer in each of the full-length layer of the inner-layer part and the full-length layer of the outer-layer part by layering two bias layers with each other in each of the inner-layer part and the outer-layer part, with reinforcing fibers of the bias layers intersecting with each other at an orientation angle of +θ° and −θ° which fall in a range not less than ±25° nor more than ±65° with respect to an axis of the golf club shaft. A straight layer is formed as an outermost full-length layer of the outer-layer part with reinforcing fiber of the straight layer orienting at not less than 0° nor more than ±10° with respect to the axis of the shaft.

In counting the number of the full-length layers, one-round layer of one prepreg is counted as one layer.

When the number of the full-length layers is an even number, the full-length layers are divided into the inner-layer part and the outer-layer part each including the half of the total number of the full-length layers. When the number of the full-length layers is an odd number, one intermediate layer disposed between the inner-layer part and the outer-layer part is not counted, but the full-length layers are divided into the inner-layer part and the outer-layer part each including the half of the total number of the full-length layers except the intermediate layer.

It is possible to decrease the torque value of the shaft without changing a predetermined degree of the flexure and weight thereof by disposing the bias layer in both the inner-layer part and the outer-layer part thereof in a favorable balance, unlike many conventional shafts in which the bias layer is disposed at the inner side.

As the fibrous (orientation) angle of the bias layer becomes smaller, the bias layer increasingly contributes to the improvement of the bending strength of the shaft. As the fibrous angle of the bias layer becomes larger, the bias layer increasingly contributes to the improvement of the crushing strength of the shaft. Therefore it is possible to enhance the strength of the shaft in a favorable balance by altering and adjusting the fibrous angle of the bias layer in the range from ±25° to ±65°.

By forming the full-length straight layer as the outermost layer of the shaft, the bias layer is not adversely affected by polishing of the surface of the shaft. Thus the bias layer allows the shaft to display a sufficient performance in its strength and torque.

Therefore even a lightweight shaft is allowed to have a high strength without changing a predetermined weight thereof and have a desired degree of flexure and torque in a favorable balance, thus having improvement in hitting a golf ball a long distance and in a desired direction.

The orientation angle of the reinforcing fiber of the bias layer is set to the range from ±25° to ±65° to the axis of the shaft for the following reason: The orientation angle of the reinforcing fiber of the bias layer less than ±25° or larger than ±65° to the axis of the shaft departs from the twist direction of the shaft. Thus the shaft is incapable of obtaining a desired torque and hitting the golf ball in a desired direction.

The bias layers may be wound round a mandrel with the prepregs having the orientation angle of +θ° and −θ° layered on each other. Alternatively one bias layer may be wound round the mandrel and thereafter the other bias layer may be wound thereon.

The reason the golf club shaft of the present invention has at least six full-length layers is described below. Each of the inner-layer part and the outer-layer part has one pair of the bias set layers, namely, two full-length layers. In addition, the shaft has the straight layer formed on the peripheral part thereof. Thus the shaft has at least three full-length layers formed in the outer-layer part thereof. Because it is preferable that the inner-layer part has the straight layer formed at the boundary between the inner-layer part and the outer-layer part, the shaft has three full-length layers formed in the inner-layer part thereof. Therefore the shaft has at least six full-length layers in total.

As described previously, it is preferable that when the number of the full-length layers is an odd number, one intermediate layer disposed between the inner-layer part and the outer-layer part is formed as the full-length straight layer. By disposing the straight layer between the inner-layer part and the outer-layer part, it is possible to minimize a decrease of the flexure of the shaft and reduce the torque thereof.

It is preferable that the weight of the shaft is set to not less than 50 g nor more than 70 g and that the ratio of the orientation angle ±θ2° of the reinforcing fiber of the full-length bias set layer of the outer-layer part to the orientation angle ±θ1° of the reinforcing fiber of the full-length bias set layer of the inner-layer part is set to not less than 1 nor more than 2.

By setting the ratio θ2/θ1, namely, the ratio of the fibrous angle of the outer bias set layer to that of the inner bias set layer to not less than 1 nor more than 2, it is possible to improve the strength of the shaft in correspondence to the weight and thickness thereof. More specifically, the ratio θ2/θ1 is set to not less than 1 nor more than 2 for the reason described below. If the ratio θ2/θ1 is set below 1, a predetermined flexure value of the shaft can be maintained but the strength thereof in the crushing direction decreases. Consequently the predetermined bending strength of the shaft decreases. On the other hand, if the ratio θ2/θ1 is set above 2, the predetermined strength of the shaft can be maintained but the predetermined flexure value thereof becomes excessively large and hence energy loss occurs. Thereby the golf ball is hit a short distance.

The ratio θ2/θ1 is set to more favorably not less than 1.2 and most favorably not less than 1.3 as the lower limit value thereof. The ratio θ2/θ1 is set to more favorably not more than 1.8 and most favorably not more than 1.5 as the upper limit value thereof.

As the fibrous angle θ1 of the inner-layer part becomes smaller, the bending strength of the shaft becomes increasingly high. Therefore the fibrous angle θ1 is favorably not less than 25° nor more than 50°, more favorably not less than 25° nor more than 45°, and most favorably not less than 25° nor more than 40°.

As the fibrous angle θ2 of the outer-layer part becomes larger, the strength of the shaft in the crushing direction becomes increasingly high. In a thin lightweight shaft, as the strength of the shaft in the crushing direction thereof becomes higher, the bending strength thereof becomes increasingly high. Therefore the fibrous angle θ2 of the outer-layer part is favorably not less than 40° nor more than 65°, more favorably not less than 45° nor more than 65°, and most favorably not less than 50° nor more than 65°.

The reason the weight of the shaft is set to not less than 50 g nor more than 70 g is as described below. If the weight of the shaft is below 50 g, the center of gravity thereof is disposed at a position on the head side where the balance of the golf club is adjusted, which makes a golfer feel that the golf club is heavy and has difficulty in swinging it. On the other hand, if the weight of the shaft is more than 70 g, the shaft prevents a head speed from being high, thereby causing the ball to be hit a short distance.

The ratio of a thickness T2 of the full-length bias set layer of the outer-layer part (hereinafter often referred to as an outer full-length bias set layer) to a thickness T1 of the full-length bias set layer of the inner-layer part (hereinafter referred to as an inner full-length bias set layer) is set to not less than 1 nor more than 1.4.

Thereby it is possible to decrease the torque of the shaft without changing the predetermined strength thereof.

The ratio of T2/T1 is set to not less than 1 nor more than 1.4 for the reason described below. If the ratio of T2/T1 is set below 1, the shaft has a small effect of decreasing the torque of the shaft and little improvement in hitting the golf ball in a desired direction. On the other hand, if the ratio of T2/T1 is set above 1.4, the shaft has a low torque and hence it is difficult for the shaft to twist. In this case, the straight layer is disposed relatively inward. Thereby the shaft has a large flexure and a low strength. It is favorable that the ratio of T2/T1 is not less than 1.1.

As resin which is used as the fiber reinforced resin, thermosetting resin and thermoplastic resin can be used. In consideration of the strength and rigidity of the shaft, the thermosetting resin is preferable. Epoxy resin is particularly favorable.

The following thermosetting resins can be used: epoxy resin, unsaturated polyester resin, phenol resin, melamine resin, urea resin, diallyl phthalate resin, polyurethane resin, polyimide resin, and silicon resin.

The following thermoplastic resins can be used: polyamide resin, saturated polyester resin, polycarbonate resin, ABS resin, polyvinyl chloride resin, polyacetal resin, polystyrene resin, polyethylene resin, polyvinyl acetate, AS resin, methacrylate resin, polypropylene resin, and fluorine resin.

As reinforcing fiber for the fiber reinforced resin, carbon fiber is preferable because it has a small specific gravity and a high modulus of elasticity and strength. In addition, fibers used as high-performance reinforcing fibers are used as the reinforcing fiber. For example, graphite fiber, aramid fiber, silicon carbide fiber, alumina fiber, boron fiber, and glass fiber are used.

The effect of the present invention is described below. As apparent from the foregoing description, according to the present invention, the bias layers influencing the torque of the shaft are not increased in the number thereof but are disposed in both the inner-layer part and the outer-layer part in a favorable balance. Further by disposing the straight layer as the outermost full-length layer, it is possible to prevent the weight of the shaft from increasing and obtain the effect of decreasing the torque thereof, with the shaft maintaining the predetermined strength and flexure thereof. Therefore the golf club shaft of the present invention is lightweight, has a high strength, and is capable of hitting the ball a long distance and in a desired direction in a favorable balance.

By altering and adjusting the fibrous angle of the bias layers in the range from ±25° to ±65°, it is possible to increase or decrease the bending strength and crushing strength of the shaft, with the shaft maintaining a low torque. Therefore it is possible to provide the shaft with a desired degree of torque and strength in a favorable balance.

By setting the ratio of the fibrous angle θ2 of the outer full-length bias set layer to the fibrous angle θ1 of the inner full-length bias set layer to not less than 1 nor more than 2, it is possible to provide the shaft with a desired degree of the crushing strength and flexure in a favorable balance.

By setting the ratio of the thickness T2 of the outer full-length bias set layer to the thickness T1 of the inner full-length bias set layer to not less than 1 nor more than 1.4, it is possible to provide the shaft with a torque-decreasing effect and a desired degree of the flexure in a favorable balance.

DETAILED DESCRIPTION OF THE PREFERRED EMBODIMENTS

The embodiments of the present invention will be described below with reference to the drawings.

Figure 1:
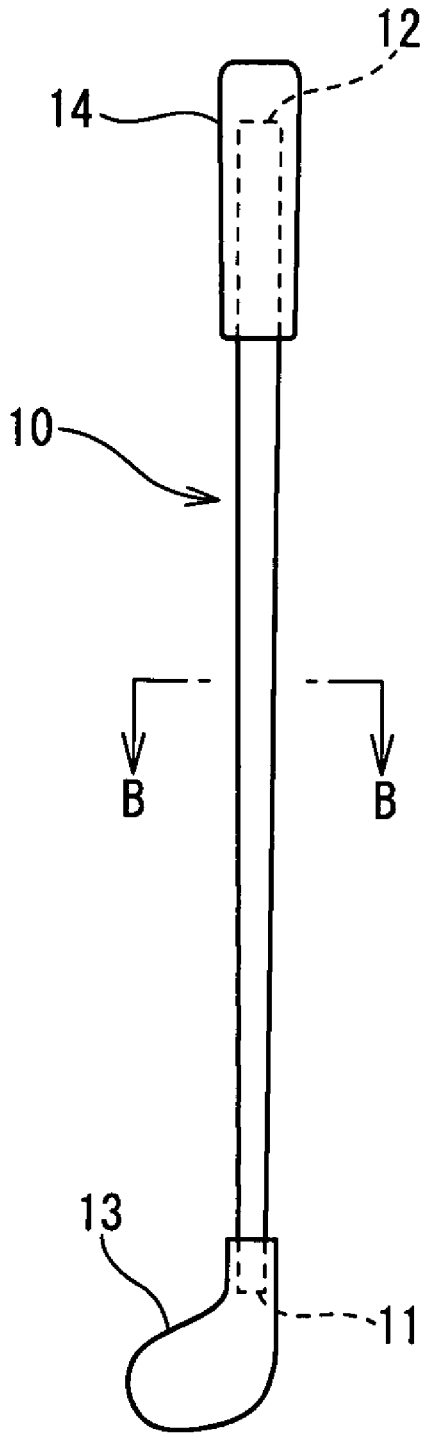
FIG. 1 is a schematic view showing a golf club according to a first embodiment of the present invention.
Figure 2:
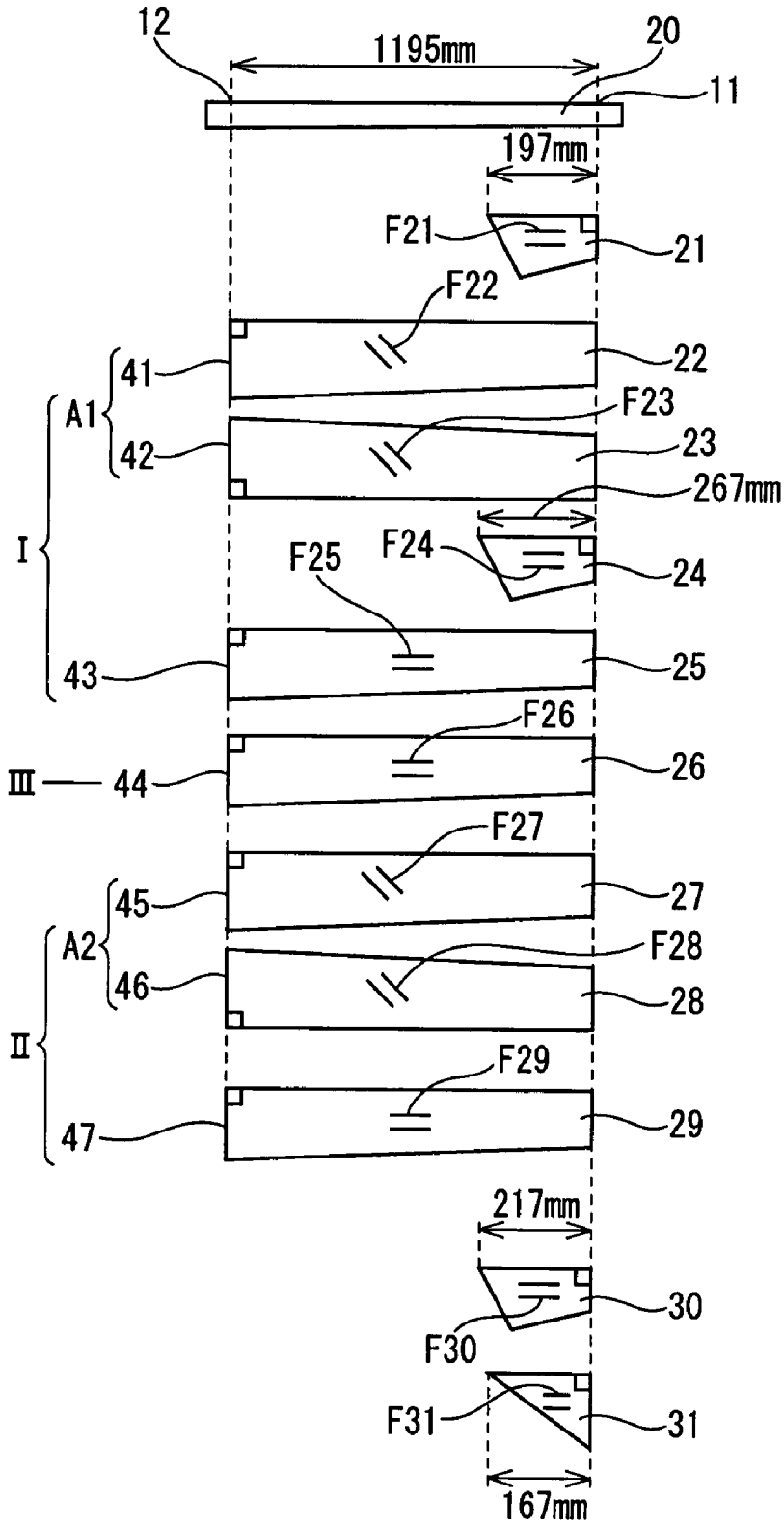
FIG. 2 shows a layered construction of prepregs of the golf club shaft shown in FIG. 1.
Figure 3:
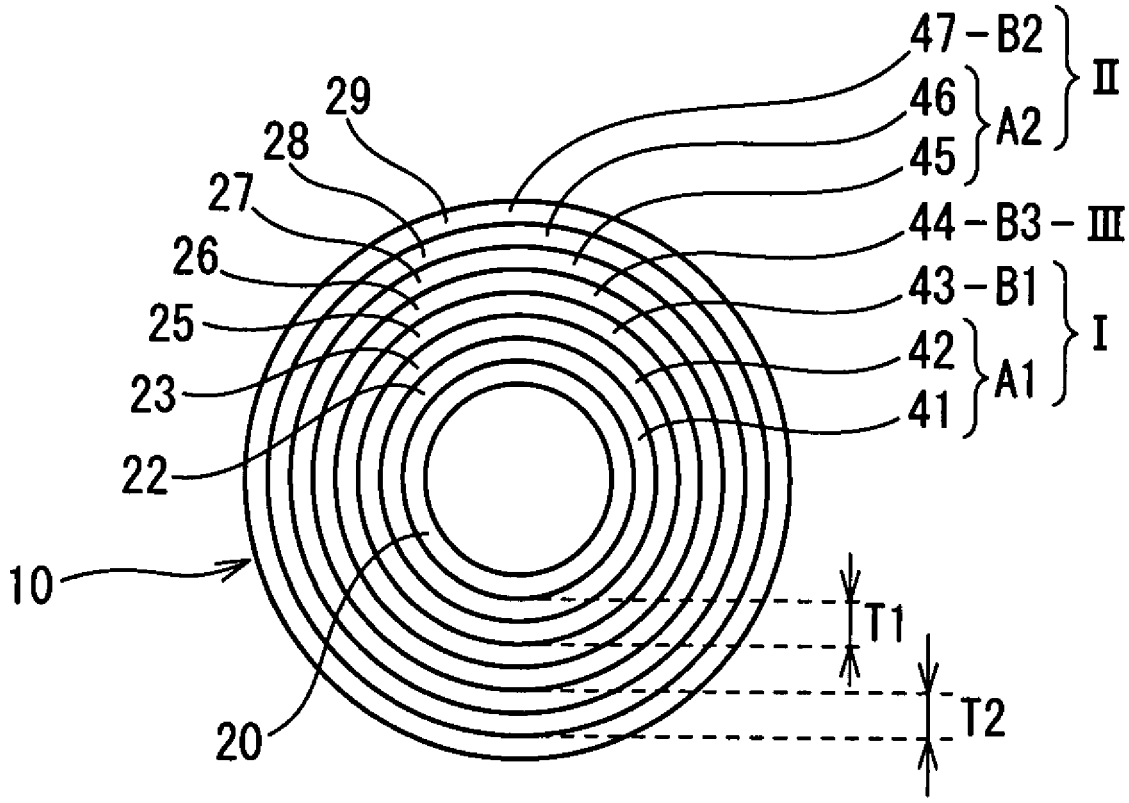
FIG. 3 is a sectional view taken along a line B-B of FIG. 1.

FIGS. 1 through 3 show a golf club shaft 10 (hereinafter often referred to as merely shaft 10) according to a first embodiment of the present invention. The shaft 10 is composed of a tapered long tubular body composed of a laminate of prepregs 21 through 31. Seven prepregs 22, 23, 25, 26, 27, 28, and 29 of the entire prepregs 21 through 31 are formed as full-length layers disposed over the whole length of the shaft 10. A head 13 is mounted on a head-side tip 11 having the smallest diameter. A grip 14 is mounted on a grip-side butt 12 having the largest diameter. The full length of the shaft 10 is set to 1195 mm. The weight of the shaft 10 is set to 61 g.

As shown in FIG. 2, the shaft 10 is manufactured as follow: The prepregs 21 through 31 are sequentially wound round a mandrel 20 and layered in the order from the prepreg 21 to the prepreg 31 and layered by using a sheet winding method. Thereafter the laminate of the prepregs 21 through 31 is wrapped with a tape (not shown) made of polyethylene or polyethylene terephthalate under pressure. The laminate wrapped with the tape is heated in an oven under pressure to integrally mold the prepregs 21 through 31 by hardening the resin thereof. Thereafter, the mandrel 20 is drawn out of the laminate. After the surface of the shaft 10 is polished, both ends thereof are cut off. Thereafter the shaft 10 is painted.

The prepregs 21 through 31 constituting the shaft 10 are respectively composed of reinforcing fibers F21 through F31 made of carbon fibers impregnated with the epoxy resin. Thermosetting resin other than the epoxy resin may be used to impregnate the carbon fiber.

More specifically, the prepreg 21 is disposed at the head-side tip portion of the shaft 10 and has a length of 197 mm. The orientation angle of the reinforcing fiber F21 of the prepreg 21 is set to 0° with respect to the axis of the shaft 10.

The prepregs 22 and 23 are disposed over the full length of the shaft 10. The orientation angle of the reinforcing fiber F22 of the prepreg 22 is set to −45° with respect to the axis of the shaft 10. The orientation angle of the reinforcing fiber F23 of the prepreg 23 is set to +45° with respect to the axis of the shaft 10. The prepregs 22, 23 are wound round the shaft 10 after the prepregs 22, 23 are bonded to each other with the reinforcing fiber F22, F23 intersecting with each other to form an inner full-length bias set layer A1 which will be described later.

The prepreg 24 is disposed at the head-side tip portion of the shaft 10 and has a length of 267 mm. The orientation angle of the reinforcing fiber F24 of the prepreg 24 is set to 0° with respect to the axis of the shaft 10.

The prepregs 25 and 26 are disposed over the full length of the shaft 10. The orientation angle of the reinforcing fibers F25, F26 of the prepregs 25, 26 is set to 0° with respect to the axis of the shaft 10.

The prepregs 27 and 28 are disposed over the full length of the shaft 10. The orientation angle of the reinforcing fiber F27 of the prepreg 27 and that of the reinforcing fiber F28 of the prepreg 28 are set to −45° and +45° respectively with respect to the axis of the shaft 10. The prepregs 27, 28 are wound round the shaft 10 after the prepregs 27, 28 are bonded to each other with the reinforcing fiber F27, F28 intersecting with each other to form an outer full-length bias set layer A2 which will be described later.

The prepreg 29 is disposed over the full length of the shaft 10. The orientation angle of the reinforcing fiber F29 of the prepreg 29 is set to 0° with respect to the axis of the shaft 10.

The prepreg 30 is disposed at the head-side tip portion of the shaft 10 and has a length of 217 mm. The orientation angle of the reinforcing fiber F30 of the prepreg 30 is set to 0° with respect to the axis of the shaft 10.

The prepreg 31 is disposed at the head-side tip portion of the shaft 10 and has a length of 167 mm. The orientation angle of the reinforcing fiber F31 of the prepreg 31 is set to 0° with respect to the axis of the shaft 10.

The prepregs 22, 23, 25, 26, 27, 28, and 29 of the shaft 10 form the full-length layers 41 through 47 respectively.

More specifically, as also shown in FIG. 3, the inner full-length bias set layer A1 consisting of the prepregs 22, 23 and a full-length straight layer B1 consisting of the prepreg 25 are disposed in an inner-layer part I including the three full-length layers 41 through 43 disposed at the central side of the shaft 10.

An outer full-length bias set layer A2 consisting of the prepregs 27, 28 and an outermost full-length bias set layer B2 consisting of the prepreg 29 are disposed in an outer-layer part II including the three full-length layers 45 through 47 disposed at the peripheral side of the shaft 10. A full-length straight layer B3 consisting of the prepreg 26 is disposed in an intermediate-layer part III consisting of the full-length layer 44.

The thickness T1 of the inner bias set layer A1 and the thickness T2 of the outer bias set layer A2 are set to 0.315 mm. The thickness of each of the full-length straight layers B1 through B3 is set to 0.158 mm.

In the shaft 10 having the above-described construction, neither the number of the bias layers influencing the torque of the shaft 10 nor the weight of the prepreg per area is increased. In the conventional art, the full-length bias layer is disposed in only the inner-layer part of a shaft. But in the shaft 10, the full-length bias layer is divided into the inner full-length bias set layer A1 and the outer full-length bias set layer A2 to dispose the full-length bias layer at not only the inner-layer part I but also at the outer-layer part II so that the full-length bias layers are disposed in a favorable balance. Therefore it is possible to decrease the torque of the shaft 10 without increasing the weight thereof and without changing a desired degree of the flexure and strength thereof. Thereby the shaft 10 is allowed to have a light weight and a high strength and hit a ball a long distance in a desired direction.

Further because the outermost full-length bias set layer B2 is formed on the periphery of the outer full-length bias set layer A2, it is possible to prevent the outer full-length bias set layer A2 from being adversely affected by the polishing of the surface of the shaft 10 necessary to be done before the surface thereof is painted. Thus the outermost full-length bias set layer B2 is capable of sufficiently displaying the effect of decreasing the torque.

The orientation angle of the reinforcing fibers F22, F23, F27, and F28 of the full-length bias set layers A1 and A2 with respect to the axis of the shaft 10 is set to +45° or −45° which are in the range from not less than ±25° to nor more than ±65°. Thus the full-length bias set layers A1 and A2 are capable of sufficiently displaying the torque-decreasing effect and enhancing the strength of the shaft in each of the bending direction and crushing direction thereof in a favorable balance.

EXAMPLES

The golf club shafts of examples 1 through 11 of the present invention and those of comparison examples 1 through 5 are described below in detail.

As shown in table 1, the golf club shafts of the examples 1 through 11 of the present invention and those of comparison examples 1 through 5 were made by differentiating the fibrous angles (the orientation angle of the reinforcing fiber with respect to the axis of the shaft) and thicknesses of the full-length layers 41 through 47 from one another respectively to measure the grip-side flexure, torque, three-point bending strength, and crushing strength thereof. Tables 1 and 2 show the results.

TABLE 1

| | | Example 1 | Example 2 | Example 3 | Example 4 |
|---|---|---|---|---|---|
| Layered construction | 41 | −45 MR350C-125S | −45 MR350C-100S | −45 MR350C-150S | −45 MR350C-075S |
| | 42 | 45 MR350C-125S | 45 MR350C-100S | 45 MR350C-150S | 45 MR350C-075S |
| | 43 | 0 MR350C-125S | 0 MR350C-125S | 0 MR350C-125S | 0 MR350C-125S |
| | 44 | 0 MR350C-125S | 0 MR350C-125S | 0 MR350C-125S | 0 MR350C-125S |
| | 45 | −45 MR350C-125S | −45 MR350C-150S | −45 MR350C-100S | −45 MR350C-175S |
| | 46 | 45 MR350C-125S | 45 MR350C-150S | 45 MR350C-100S | 45 MR350C-175S |
| | 47 | 0 MR350C-125S | 0 MR350C-125S | 0 MR350C-125S | 0 MR350C-125S |
| 41, 42 Fibrous angle [°] bias set layer A1 (θ1) | | 45 | 45 | 45 | 45 |
| 45, 46 Fibrous angle [°] bias set layer A2 (θ2) | | 45 | 45 | 45 | 45 |
| 43, 44, 47 Fibrous angle [°] straight layer | | 0 | 0 | 0 | 0 |
| Ratio (θ2/θ1) | | 1.00 | 1.00 | 1.00 | 1.00 |
| 41, 42 Thickness [mm] Bias set layer A1 (T1) | | 0.315 | 0.2625 | 0.3675 | 0.21 |
| 45, 46 Thickness [mm] Bias set layer A2 (T2) | | 0.315 | 0.3675 | 0.2625 | 0.42 |
| 43, 44, 47 Thickness [mm] straight layer | | 0.158 | 0.158 | 0.158 | 0.158 |
| Ratio (T2/T1) | | 1.00 | 1.4 | 0.71 | 2 |
| Weight [g] of shaft | | 61 | 61 | 61 | 61 |
| Shaft balance [mm] | | 612 | 612 | 612 | 612 |
| Grip-side flexure [mm] | | 108 | 110 | 107 | 116 |
| Torque [degree] | | 4.2 | 4.0 | 4.2 | 4 |

TABLE 1-continued

| | | | | |
|---|---|---|---|---|
| Three-point bending strength [kgf] | | | | |
| Point A (175 mm) | 81 | 81 | 81 | 78 |
| Point B (525 mm) | 92 | 91 | 94 | 89 |
| Point C (993 mm) | 127 | 126 | 130 | 123 |
| Crushing strength [kgf] | | | | |
| Point A (175 mm) | 23 | 23 | 22 | 22 |
| Point B (525 mm) | 19 | 19 | 18 | 18 |
| Point C (993 mm) | 12 | 13 | 11 | 12 |

| | | Example 5 | Example 6 | Example 7 | Example 8 |
|---|---|---|---|---|---|
| Layered construction | 41 | −45 MR350C-150S | −30 MR350C-125S | −60 MR350C-125S | −30 MR350C-125S |
| | 42 | 45 MR350C-150S | 30 MR350C-125S | 60 MR350C-125S | 30 MR350C-125S |
| | 43 | 0 MR350C-125S | 0 MR350C-125S | 0 MR350C-125S | 0 MR350C-125S |
| | 44 | 0 MR350C-125S | 0 MR350C-125S | 0 MR350C-125S | 0 MR350C-125S |
| | 45 | −45 MR350C-175S | −30 MR350C-125S | −60 MR350C-125S | −60 MR350C-125S |
| | 46 | 45 MR350C-175S | 30 MR350C-125S | 60 MR350C-125S | 60 MR350C-125S |
| | 47 | 0 MR350C-125S | 0 MR350C-125S | 0 MR350C-125S | 0 MR350C-125S |
| 41, 42 Fibrous angle [°] bias set layer A1 (θ1) | | 45 | 30 | 60 | 30 |
| 45, 46 Fibrous angle [°] bias set layer A2 (θ2) | | 45 | 30 | 60 | 60 |
| 43, 44, 47 Fibrous angle [°] straight layer | | 0 | 0 | 0 | 0 |
| Ratio (θ2/θ1) | | 1.00 | 1.00 | 1.00 | 1.00 |
| 41, 42 Thickness [mm] Bias set layer A1 (T1) | | 0.3675 | 0.315 | 0.315 | 0.315 |
| 45, 46 Thickness [mm] Bias set layer A2 (T2) | | 0.42 | 0.315 | 0.315 | 0.315 |
| 43, 44, 47 Thickness [mm] straight layer | | 0.158 | 0.158 | 0.158 | 0.158 |
| Ratio (T2/T1) | | 1.1 | 1.00 | 1.00 | 1.00 |
| Weight [g] of shaft | | 61 | 61 | 61 | 61 |
| Shaft balance [mm] | | 612 | 612 | 612 | 612 |
| Grip-side flexure [mm] | | 107 | 107 | 109 | 108 |
| Torque [degree] | | 4.5 | 4.3 | 4.3 | 4.4 |
| Three-point bending strength [kgf] | | | | | |
| Point A (175 mm) | | 82 | 88 | 85 | 86 |
| Point B (525 mm) | | 92 | 93 | 93 | 94 |
| Point C (993 mm) | | 126 | 127 | 136 | 136 |
| Crushing strength [kgf] | | | | | |
| Point A (175 mm) | | 22 | 20 | 25 | 25 |
| Point B (525 mm) | | 18 | 17 | 20 | 21 |
| Point C (993 mm) | | 12 | 11 | 13 | 14 |

| | | Example 9 | Example 10 | Example 11 |
|---|---|---|---|---|
| Layered construction | 41 | −30 MR350C-125S | −45 MR350C-125S | 0 MR350C-125S |
| | 42 | 30 MR350C-125S | 45 MR350C-125S | −45 MR350C-125S |
| | 43 | 0 MR350C-125S | 0 MR350C-125S | 45 MR350C-125S |
| | 44 | 0 MR350C-125S | 0 MR350C-125S | 0 MR350C-125S |
| | 45 | −45 MR350C-125S | −60 MR350C-125S | −45 MR350C-125S |
| | 46 | 45 MR350C-125S | 60 MR350C-125S | 45 MR350C-125S |
| | 47 | 0 MR350C-125S | 0 MR350C-125S | 0 MR350C-125S |
| 41, 42 Fibrous angle [°] bias set layer A1 (θ1) | | 30 | 45 | 45 |
| 45, 46 Fibrous angle [°] bias set layer A2 (θ2) | | 45 | 60 | 45 |
| 43, 44, 47 Fibrous angle [°] straight layer | | 0 | 0 | 0 |
| Ratio (θ2/θ1) | | 1.50 | 1.33 | 1.00 |
| 41, 42 Thickness [mm] Bias set layer A1 (T1) | | 0.315 | 0.315 | 0.315 |
| 45, 46 Thickness [mm] Bias set layer A2 (T2) | | 0.315 | 0.315 | 0.315 |
| 43, 44, 47 Thickness [mm] straight layer | | 0.158 | 0.158 | 0.158 |
| Ratio (T2/T1) | | 1.00 | 1.00 | 1.00 |
| Weight [g] of shaft | | 61 | 61 | 61 |
| Shaft balance [mm] | | 612 | 612 | 612 |
| Grip-side flexure [mm] | | 107 | 108 | 109 |
| Torque [degree] | | 4.2 | 4.2 | 4 |
| Three-point bending strength [kgf] | | | | |
| Point A (175 mm) | | 85 | 84 | 80 |
| Point B (525 mm) | | 93 | 93 | 92 |
| Point C (993 mm) | | 135 | 134 | 127 |

TABLE 1-continued

| | | | |
|---|---|---|---|
| Crushing strength [kgf] | | | |
| Point A (175 mm) | 25 | 25 | 23 |
| Point B (525 mm) | 20 | 20 | 20 |
| Point C (993 mm) | 14 | 14 | 13 |

TABLE 2

| | | Comparison Example 1 | Comparison Example 2 | Comparison Example 3 | Comparison Example 4 | Comparison Example 5 |
|---|---|---|---|---|---|---|
| Layered construction | 41 | −45 MR350C-125S | 0 MR350C-125S | −15 MR350C-125S | −75 MR350C-125S | −15 MR350C-125S |
| | 42 | 45 MR350C-125S | 0 MR350C-125S | 15 MR350C-125S | 75 MR350C-125S | 15 MR350C-125S |
| | 43 | −45 MR350C-125S | 0 MR350C-125S | 0 MR350C-125S | 0 MR350C-125S | 0 MR350C-125S |
| | 44 | 45 MR350C-125S | −45 MR350C-125S | 0 MR350C-125S | 0 MR350C-125S | 0 MR350C-125S |
| | 45 | 0 MR350C-125S | 45 MR350C-125S | −15 MR350C-125S | −75 MR350C-125S | −75 MR350C-125S |
| | 46 | 0 MR350C-125S | 45 MR350C-125S | 15 MR350C-125S | 75 MR350C-125S | 75 MR350C-125S |
| | 47 | 0 MR350C-125S | −45 MR350C-125S | 0 MR350C-125S | 0 MR350C-125S | 0 MR350C-125S |
| 41, 42 Fibrous angle [°] bias set layer A1 (θ1) | | 45 | 45 | 45 | 75 | 15 |
| 45, 46 Fibrous angle [°] bias set layer A2 (θ2) | | — | 45 | 15 | 75 | 75 |
| 43, 44, 47 Fibrous angle [°] straight layer | | 0 | 0 | 0 | 0 | 0 |
| Ratio (θ2/θ1) | | — | — | 1.00 | 1.00 | 5.00 |
| 41, 42 Thickness [mm] Bias set layer A1 (T1) | | 0.315 | 0.315 | 0.315 | 0.315 | 0.315 |
| 45, 46 Thickness [mm] Bias set layer A2 (T2) | | 0.315 | 0.315 | 0.315 | 0.315 | 0.315 |
| 43, 44, 47 Thickness [mm] | | 0.158 | 0.158 | 0.158 | | |
| straight layer | | 0.158 | 0.158 | | | |
| Ratio (T2/T1) | | — | — | 1.00 | 1.00 | 1.00 |
| Weight [g] of shaft | | 61 | 61 | 61 | 61 | 61 |
| Shaft balance [mm] | | 612 | 612 | 612 | 612 | 612 |
| Grip-side flexure [mm] | | 105 | 118 | 106 | 115 | 112 |
| Torque [degree] | | 4.7 | 3.9 | 4.7 | 4.7 | 5.2 |
| Three-point bending strength [kgf] | | | | | | |
| B Point A (175 mm) | | 84 | 43 | 90 | 72 | 86 |
| Point B (525 mm) | | 95 | 49 | 85 | 88 | 95 |
| Point C (993 mm) | | 133 | 80 | 112 | 144 | 137 |
| Crushing strength [kgf] | | | | | | |
| Point A (175 mm) | | 24 | 15 | 15 | 27 | 24 |
| Point B (525 mm) | | 19 | 12 | 13 | 22 | 20 |
| Point C (993 mm) | | 12 | 9 | 9 | 15 | 13 |

11 prepregs used for each of the golf club shafts of the examples 1 through 11 of the present invention and the comparison examples 1 through 5 were produced by Mitsubishi Rayon Co., Ltd. Each of the 11 prepregs was composed of carbon fibers used as the reinforcing fibers thereof and epoxy resin with which the carbon fibers were impregnated. The prepregs were formed by the sheet winding method as in the case of the first embodiment. The prepregs having article numbers used in the examples and the comparison examples were produced by Mitsubishi Rayon Co., Ltd., as described above.

Any of the shafts of the examples 1 through 11 and the comparison example 1 through 5 had a length of 1195 mm. The layered position of the seven full-length layers 41 through 47 formed over the full length of the shaft and the construction of the partial reinforcing layers formed at a part of the shaft were identical to those of the first embodiment. Table 1 shows the detail of only the full-length layers 41 through 47.

The weight of the shaft of each of the examples and the comparison example and the shaft balance thereof were set as shown in table 1.

Example 1

The golf club shaft of the example 1 had the same construction as that of the shaft of the first embodiment. More specifically, the full-length layers 41 and 42 were formed as the inner full-length bias set layer A1 having a fibrous angle of −45° and +45° and a thickness of 0.315 mm respectively. The full-length layers 43 and 44 were formed as the straight layers B1 and B3 having a fibrous angle of 0° and a thickness of 0.158 mm respectively. The full-length layers 45 and 46 were formed as the outer full-length bias set layers A2 having a fibrous angle of −45° and +45° and a thickness of 0.315 mm respectively. The full-length layer 47 was formed as the outermost straight layer B2 having a fibrous angle of 0° and a thickness of 0.158 mm.

The inner bias set layer A1 was disposed in the inner-layer part I, whereas the outer bias set layer A2 was disposed in the outer-layer part II. The ratio of the fibrous angle θ2 of the outer bias set layer A2 to the fibrous angle θ1 of the inner bias-set layer A1 was set to 1.00. The ratio of the thickness T2 of the outer bias set layer A2 to the thickness T1 of the inner bias set layer A1 was also set to 1.00.

A prepreg having an article number "MR350C-125S" was used as any of the full-length layers 41 through 47.

Example 2

As the full-length layers 41, 42 constituting the inner full-length bias set layer A1, a prepreg having an article number "MR350C-100S" was used. The thickness of the inner full-length bias set layer A1 was set to 0.2625 mm. As the full-length layers 45 and 46 constituting the outer full-length bias set layer A2, a prepreg having an article number "MR350C-150S" was used. The thickness of the outer full-length bias set layer A2 was set to 0.3675 mm. The ratio of the thickness T2 of the outer full-length bias set layer A2 to the thickness T1 of the inner full-length bias set layer A1 was set to 1.4. The fibrous angle and other constructions of the shaft of the example 2 were set identically to those of the example 1.

Example 3

As the full-length layers 41, 42 constituting the inner full-length bias set layer A1, a prepreg having the article number "MR350C-150S" was used. The thickness of the inner full-length bias set layer A1 was set to 0.3675 mm. As the full-length layers 45 and 46 constituting the outer full-length bias set layer A2, a prepreg having the article number "MR350C-100S" was used. The thickness of the outer full-length bias set layer A2 was set to 0.2625 mm. The ratio of the thickness T2 of the outer full-length bias set layer A2 to the thickness T1 of the inner full-length bias set layer A1 was set to 0.71. The fibrous angle and other constructions of the shaft of the example 3 were set identically to those of the example 1.

Example 4

As the full-length layers 41, 42 constituting the inner full-length bias set layer A1, a prepreg having an article number "MR350C-075S" was used. The thickness of the inner full-length bias set layer A1 was set to 0.21 mm. As the full-length layers 45 and 46 constituting the outer full-length bias set layer A2, a prepreg having an article number "MR350C-175S" was used. The thickness of the outer full-length bias set layer A2 was set to 0.42 mm. The ratio of the thickness T2 of the outer full-length bias set layer A2 to the thickness T1 of the inner full-length bias set layer A1 was set to 2. The fibrous angle and other constructions of the shaft of the example 4 were set identically to those of the example 1.

Example 5

As the full-length layers 41, 42 constituting the inner full-length bias set layer A1, a prepreg having the article number "MR350C-150S" was used. The thickness of the inner full-length bias set layer A1 was set to 0.3675 mm. As the full-length layers 45 and 46 constituting the outer full-length bias set layer A2, a prepreg having the article number "MR350C-175S" was used. The thickness of the outer full-length bias set layer A2 was set to 0.42 mm. The ratio of the thickness T2 of the outer full-length bias set layer A2 to the thickness T1 of the inner full-length bias set layer A1 was set to 1.1. The fibrous angle and other constructions of the shaft of the example 5 were set identically to those of the example 1.

Example 6

The fibrous angles of the full-length layers 41, 42 constituting the inner full-length bias set layer A1 were set to −30° and +30° respectively. The fibrous angles of the full-length layers 45 and 46 constituting the outer full-length bias set layer A2 were also set to −30° and +30° respectively. The ratio of the fibrous angle θ2 of the outer bias set layer A2 to the fibrous angle θ1 of the inner bias set layer A1 was set to 1.00. The thickness of each layer was set equally to that of the example 1. The kind of the prepregs and other constructions were set identically to those of the example 1.

Example 7

The fibrous angles of the full-length layers 41, 42 constituting the inner full-length bias set layer A1 were set to −60° and +60° respectively. The fibrous angles of the full-length layers 45 and 46 constituting the outer full-length bias set layer A2 were also set to −60° and +60° respectively. The ratio of the fibrous angle θ2 of the outer bias set layer A2 to the fibrous angle θ1 of the inner bias set layer A1 was set to 1.00. The thickness of each layer was set equally to that of the example 1. The kind of the prepregs and other constructions were set identically to those of the example 1.

Example 8

The fibrous angles of the full-length layers 41, 42 constituting the inner full-length bias set layer A1 were set to −30° and +30° respectively. The fibrous angles of the full-length layers 45 and 46 constituting the outer full-length bias set layer A2 were set to −60° and +60° respectively. The ratio of the fibrous angle θ2 of the outer bias set layer A2 to the fibrous angle θ1 of the inner bias set layer A1 was set to 2. The thickness of each layer was set equally to that of the example 1. The kind of the prepregs and other constructions were set identically to those of the example 1.

Example 9

The fibrous angles of the full-length layers 41, 42 constituting the inner full-length bias set layer A1 were set to −30° and +30° respectively. The fibrous angles of the full-length layers 45 and 46 constituting the outer full-length bias set layer A2 were set to −45° and +45° respectively. The ratio of the fibrous angle θ2 of the outer bias set layer A2 to the fibrous angle θ1 of the inner bias set layer A1 was set to 1.5. The thickness of each layer was set equally to that of the example 1. The kind of the prepregs and other constructions were set identically to those of the example 1.

Example 10

The fibrous angles of the full-length layers 41, 42 constituting the inner full-length bias set layer A1 were set to −45° and +45° respectively. The fibrous angles of the full-length layers 45 and 46 constituting the outer full-length bias set layer A2 were set to −60° and +60° respectively. The ratio of the fibrous angle θ2 of the outer bias set layer A2 to the fibrous angle θ1 of the inner bias set layer A1 was set to 1.33. The thickness of each layer was set equally to that of the example 1. The kind of the prepregs and other constructions were set identically to those of the example 1.

Example 11

Figure 4:
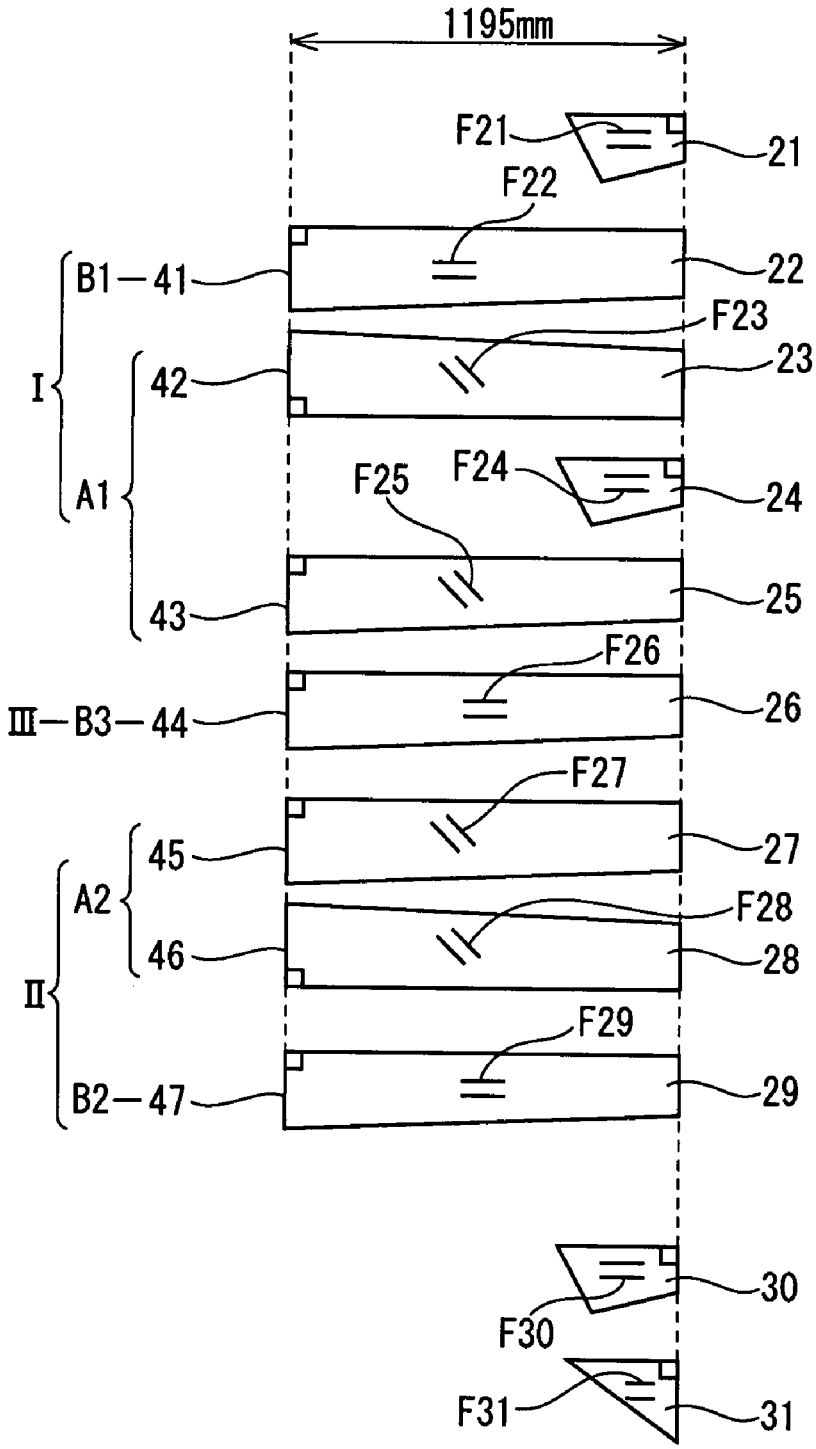
FIG. 4 shows a layered construction of prepregs of a golf club shaft of an example 11.

As shown in FIG. 4, of the full-length layers 41 through 47, the construction of the inner-layer part I of the example 11 was different from that of the example 1 in that the innermost full-length layer 41 was formed as the straight layer B1 having a fibrous angle of 0° and that the full-length layers 42 and 43 were formed as the inner full-length bias set layers A1 having a fibrous angles of −45° and +45° respectively. The thickness of each layer was set equally to that of the example 1, and the kind of the prepregs and other constructions were set identically to those of the example 1.

Comparison Example 1

Figure 5:
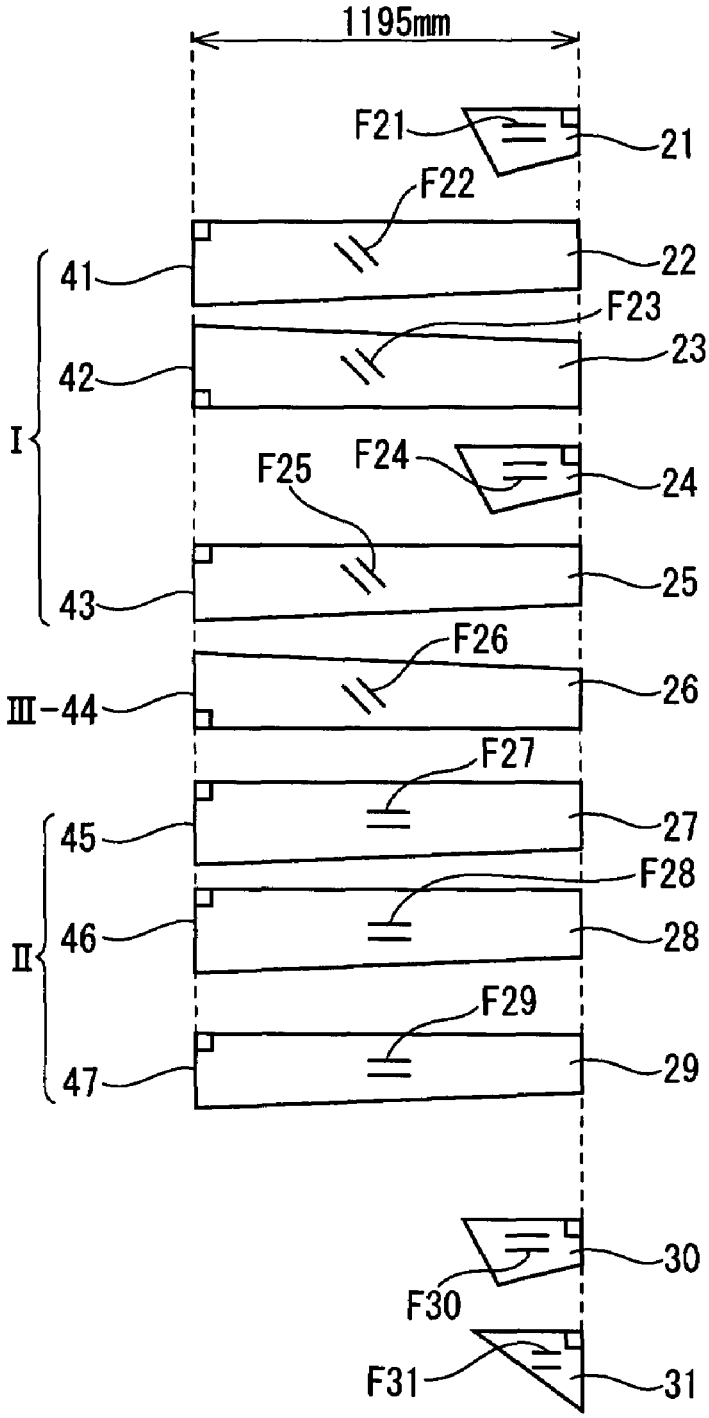
FIG. 5 shows a layered construction of prepregs of a golf club shaft of a comparison example 1.

As shown in FIG. 5, of the full-length layers 41 through 47, the bias layer was not formed in the outer-layer part II, but in only the inner-layer part I and the intermediate-layer part III. More specifically, the full-length layers 41 through 44 were formed as the bias set layers having a fibrous angle of −45°, +45+, −45°, and +45° and a thickness of 0.315 mm respectively, with the full-length layers 41 and 42 making a pair and the full-length layers 43 and 44 making another pair. The full-length layers 45 through 47 had a fibrous angle of 0° and a thickness of 0.158 mm respectively.

The kind of the prepreg composing each layer was set identically to that of the example 1.

Comparison Example 2

Figure 6:
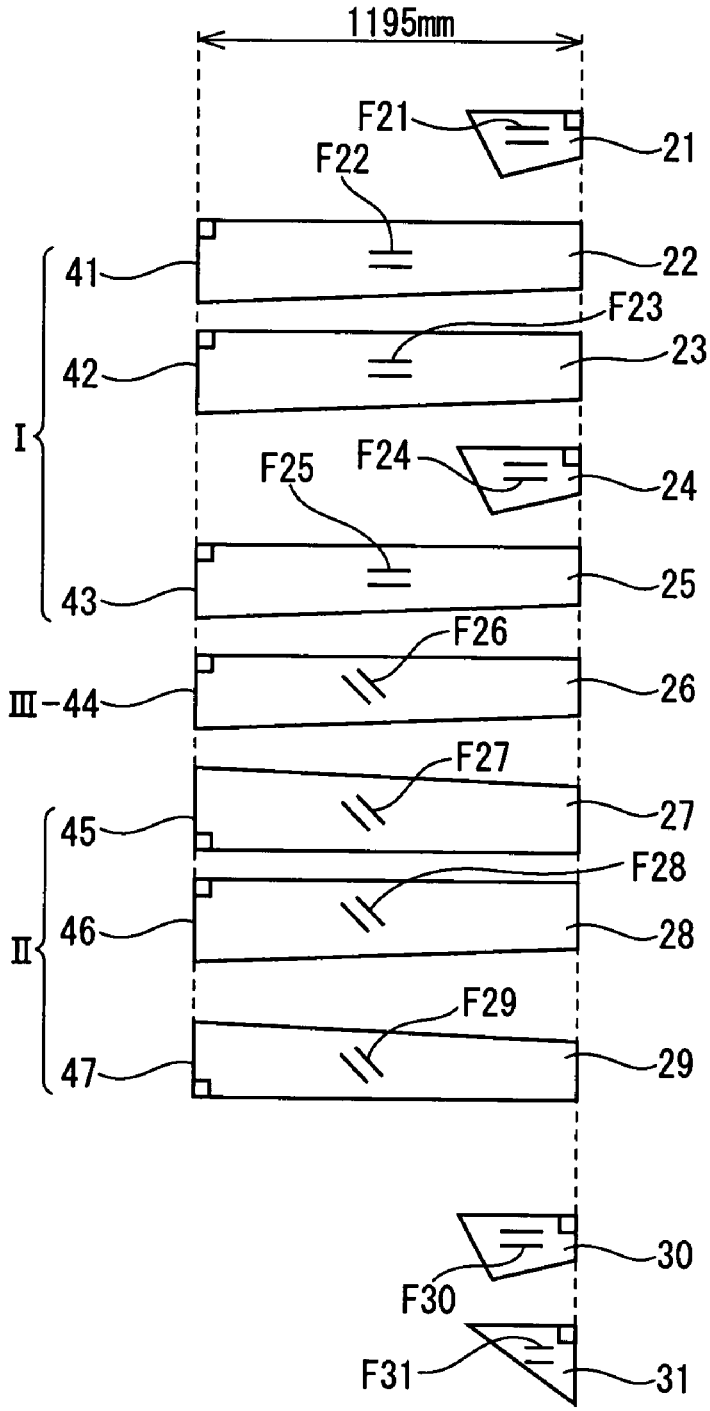
FIG. 6 shows a layered construction of prepregs of a golf club shaft of a comparison example 2.

As shown in FIG. 6, of the full-length layers 41 through 47, the bias layer was not formed in the inner-layer part I, but in only the outer-layer part II and the intermediate-layer part III. More specifically, the full-length layers 41 through 43 were formed as the straight layers having a fibrous angle of 0° and a thickness of 0.158 mm. The full-length layers 44 through 47 were formed as the bias set layers having a fibrous angle of −45°, +45°, −45°, and +45° and a thickness of 0.315 mm respectively, with the full-length layers 44 and 45 making a pair and the full-length layers 46 and 47 making another pair.

The kind of the prepreg composing each layer was set identically to that of the example 1.

Comparison Example 3

The fibrous angles of the full-length layers 41, 42 constituting the inner full-length bias set layer A1 were set to −15° and +15° respectively. The fibrous angles of the full-length layers 45 and 46 constituting the outer full-length bias set layer A2 were also set to −15° and +15° respectively. The ratio of the fibrous angle θ2 of the outer bias set layer A2 to the fibrous angle θ1 of the inner bias set layer A1 was set to 1.00. The thickness of each layer was set equally to that of the example 1. The kind of the prepregs and other constructions were set identically to those of the example 1.

Comparison Example 4

The fibrous angles of the full-length layers 41, 42 constituting the inner full-length bias set layer A1 were set to −75° and +75° respectively. The fibrous angles of the full-length layers 45 and 46 constituting the outer full-length bias set layer A2 were also set to −75° and +75° respectively. The ratio of the fibrous angle θ2 of the outer bias set layer A2 to the fibrous angle θ1 of the inner bias set layer A1 was set to 1.00. The thickness of each layer was set equally to that of the example 1. The kind of the prepregs and other constructions were set identically to those of the example 1.

Comparison Example 5

The fibrous angles of the full-length layers 41, 42 constituting the inner full-length bias set layer A1 were set to −15° and +15° respectively. The fibrous angles of the full-length layers 45 and 46 constituting the outer full-length bias set layer A2 were also set to −75° and +75° respectively. The ratio of the fibrous angle θ2 of the outer bias set layer A2 to the fibrous angle θ1 of the inner bias set layer A1 was set to 5.00. The thickness of each layer was set equally to that of the example 1. The kind of the prepregs and other constructions were set identically to those of the example 1.

Method of Measuring Grip-Side Flexure

Figure 7:
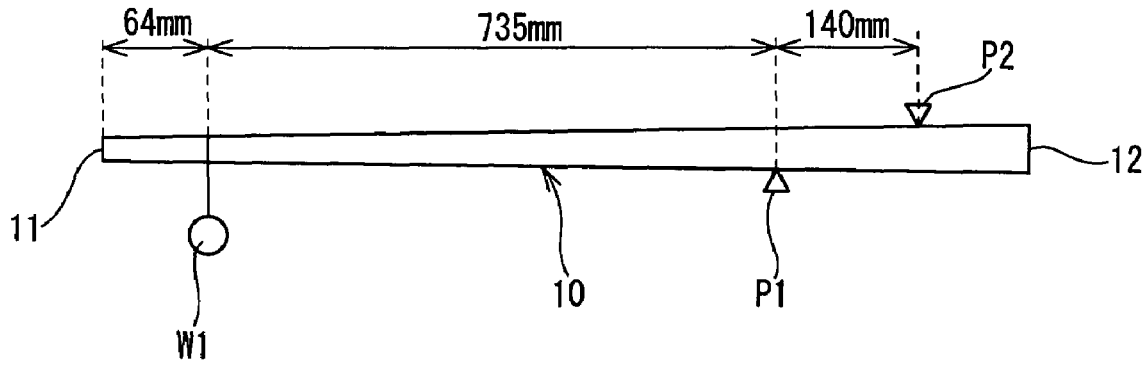
FIG. 7 shows a method of measuring a grip-side flexure.

The grip-side flexure is an index of the hardness of the shaft 10 at its grip side. As shown in FIG. 7, a position spaced at an interval of 799 mm from the head-side tip 11 of the shaft 10 is denoted as a supporting point P1. A position spaced at an interval of 140 mm from the supporting point P1 toward the grip-side butt 12 is denoted as a fixed point P2. A weight W1 having a weight of 2.7 kg was hung at a position spaced at an interval of 64 mm from the head-side tip 11 of the shaft 10 to measure the flexure amount of the shaft 10 at the head-side tip 11.

Measurement of Torque

Figure 8:
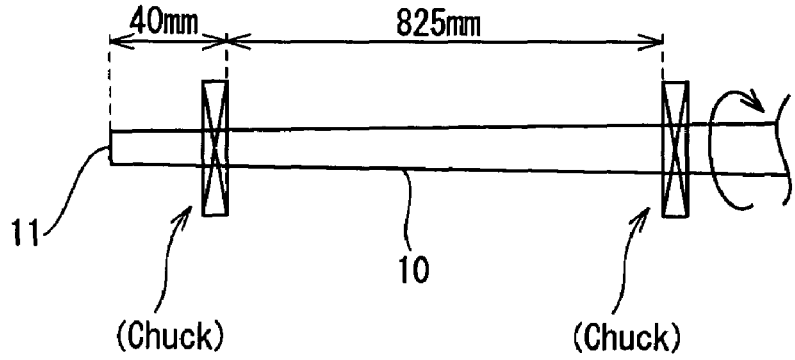
FIG. 8 shows a method of measuring a torque.

As shown in FIG. 8, to measure the torque (degree), a twist angle of each shaft 10 was measured by applying a torque of 136.3N·cm (13.9 kgf·cm) to a point spaced at 865 mm from the head-side tip 11 of the shaft 10, with a position spaced at 40 mm from the head-side tip 11 fixed.

Measurement of Three-Point Bending Strength

Figure 9:
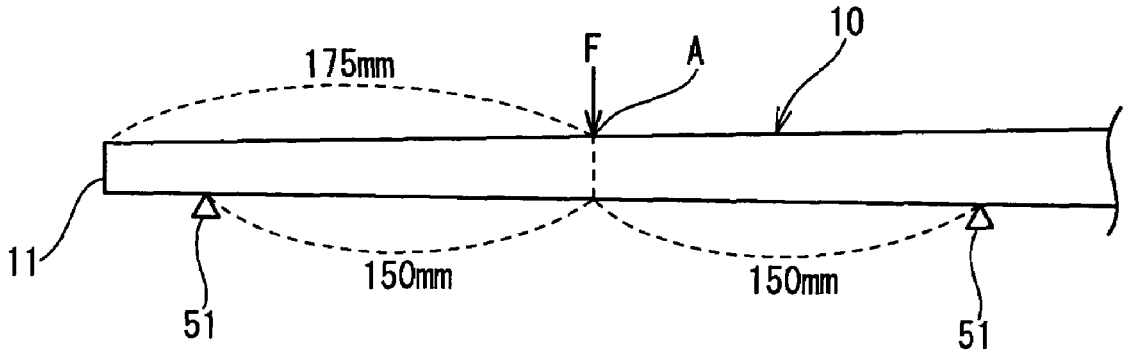
FIG. 9 shows a method of measuring a three-point bending strength.
Figure 10:
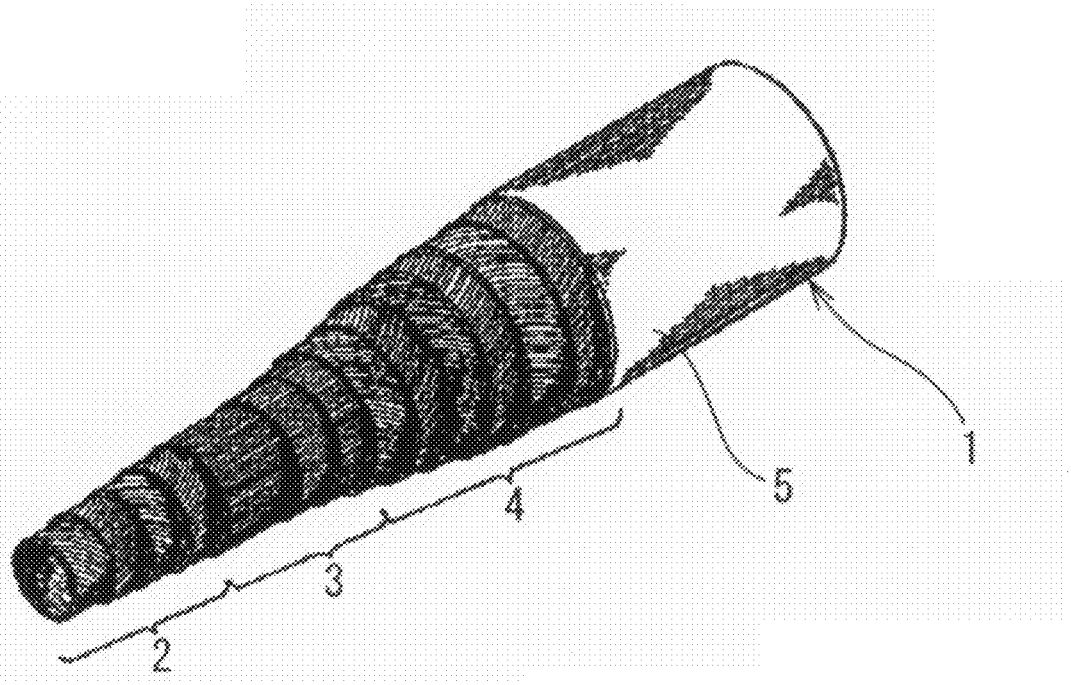
FIG. 10 shows a conventional art.

The three-point bending strength means a breaking strength provided by the Product Safety Association. As shown in FIG. 9, a load F is applied downward from an upper portion of the shaft 10 supported at three points. The value (peak value) of the load F when the shaft 10 was broken was measured. The bending strength was measured at points spaced at intervals of 175 mm (point A), 525 mm (point B), and 993 mm (point C) from the tip 11 of the shaft 10, respectively. The span between supporting points 51 was 300 mm. FIG. 9 shows the case in which the bending strength was measured at the point A).

Measurement of Crushing Strength

To measure the crushing strength of each shaft 10, by using a utility compression testing machine, a compressive test was conducted by forming a specimen having a length of about 10 mm, with the center thereof disposed at positions of 10 mm, 100 mm, 200 mm, and 300 mm from the grip-side butt 12 of the shaft 10.

It could be confirmed from table 1 that the shafts of the examples 1 through 11 had a low torque and a desired degree of flexure and strength because in the shafts, the full-length bias layers were disposed in the inner-layer part I and the outer-layer part II in a favorable balance.

It was confirmed that the shaft of the comparison example 1 in which the full-length bias layers was disposed in only the inner-layer part I had a large torque. It was also confirmed that the shaft of the comparison example 2 in which the full-length bias layers was disposed in only the outer-layer part II had a low torque, but had an excessive degree of flexure and further a low bending strength and crushing strength.

The shaft of the comparison example 3 in which the fibrous angle of the bias layer was set below ±25° and the shaft of the comparison example 4 in which the fibrous angle of the bias layer was set above ±65° did not have a low torque and in addition had a low strength, although the ratio of the fibrous angle θ2 of the outer bias set layer to the fibrous angle θ1 of the inner bias set layer was set to 1.

It was confirmed that the shaft of the comparison example 5 in which the ratio of the fibrous angle θ2 of the outer bias set layer to the fibrous angle θ1 of the inner bias set layer was more than 2 had a large torque and an excessively large flexure.

The torque was low and the flexure degree was not high in the shaft of the examples 1 through 7 and 11 in which the ratio of the fibrous angle θ2 of the outer bias set layer to the fibrous angle θ1 of the inner bias set layer was 1.00 and the shaft of the examples 8, 9, and 10 in which the ratio of the fibrous angle θ2 of the outer bias set layer to the fibrous angle θ1 of the inner bias set layer was more than 1 not more than 2. The shafts of the examples 8, 9, and 10 were higher than those of the examples 1 through 7 and 11 in the crushing strengths thereof.

The shaft of the example 4 in which the ratio of the thickness T2 of the outer full-length bias set layer to the thickness T1 of the inner full-length bias set layer was larger than 1.4 had a much higher flexure degree than the shafts of the examples 1, 2, and 5 and a lower bending strength than the shafts of the examples 1, 2, and 5.

What is claimed is:

1. A golf club shaft having a weight of not less than 50 g nor more than 70 g, composed of a laminate of prepregs with full-length layers which are formed over a full length of said golf club shaft, wherein there are only seven full-length layers, wherein said full-length layers are divided into an inner-layer part, including three of said full-length layers, which is disposed at a central side of said golf club shaft, an outer-layer part, including three of said full-length layers, which is disposed at an outer side of said golf club shaft and an intermediate layer including one of said full-length layers which is composed of a straight layer and disposed between said inner-layer part and said outer-layer part, one pair of said full-length layers is formed as a bias set layer in each of said full-length layers of said inner-layer part and said full-length layers of said outer-layer part by layering two bias layers with each other in each of said inner-layer part and said outer-layer part, with reinforcing carbon fibers of said bias layers intersecting with each other at an orientation angle of +θ° and −θ° which falls in a range not less than ±25° nor more than ±65° with respect to an axis of said golf club shaft;

a straight layer is formed as an outermost full-length layer of said outer-layer part with reinforcing carbon fibers of said straight layer oriented at not less than 0° nor more than ±10° with respect to said axis of said shaft;

a straight layer is formed in said inner-layer part with reinforcing carbon fibers of said straight layer oriented at not less than 0° nor more than ±10° with respect to said axis of said shaft, a prepreg is disposed only at a head-side, top portion of the golf club shaft with reinforcing carbon fibers formed at an angle of 0° with respect to the axis of the golf club shaft, and is formed at the inner side of the inner layer part, a prepreg is disposed only at a head-side, top portion of the golf club shaft with reinforcing carbon fibers formed at an angle of 0° with respect to the axis of the golf club shaft, and is formed at the outer side of the outer layer part, and a prepreg is disposed only at a head-side top portion of the golf club shaft with reinforcing carbon fibers formed at an angle of 0° with respect to the axis of the golf club shaft, and is formed between the second full length layer and the third full length layer from the inner side of the inner layer part.

2. The golf club shaft according to claim 1, wherein a ratio of an orientation angle ±θ2° of said carbon reinforcing fiber of said full-length bias set layer of said outer-layer part to an orientation angle ±θ1° of said carbon reinforcing fiber of said full-length bias set layer of said inner-layer part is set to not less than 1 nor more than 2.

3. The golf club shaft according to claim 1, wherein a ratio of a thickness T2 of said full-length bias set layer of said outer-layer part to a thickness T1 of said full-length bias set layer of said inner-layer part is set to not less than 1 nor more than 1.4.

4. The golf club shaft according to claim 2, wherein a ratio of a thickness T2 of said full-length bias set layer of said outer-layer part to a thickness T1 of said full-length bias set layer of said inner-layer part is set to not less than 1 nor more than 1.4.

* * * * *